US008186505B1

(12) United States Patent
Saucedo

(10) Patent No.: US 8,186,505 B1
(45) Date of Patent: May 29, 2012

(54) EXPANSIBLE BALLISTIC CONTAINMENT BAG

(75) Inventor: Kent D. Saucedo, Mesa, AZ (US)

(73) Assignee: Armorworks Enterprises, LLC, Chandler, AZ (US)

( * ) Notice: Subject to any disclaimer, the term of this patent is extended or adjusted under 35 U.S.C. 154(b) by 0 days.

(21) Appl. No.: 12/660,186

(22) Filed: Feb. 22, 2010

Related U.S. Application Data

(60) Provisional application No. 61/208,143, filed on Feb. 20, 2009.

(51) Int. Cl.
*F41C 27/00* (2006.01)

(52) U.S. Cl. ..... 206/3; 190/27; 190/127; 383/119

(58) Field of Classification Search ..... 206/3; 383/78, 383/81, 98, 99, 119, 2, 105, 903; 190/37, 190/127
See application file for complete search history.

(56) References Cited

U.S. PATENT DOCUMENTS 841,620 A * 1/1907 Buchanan ..... 190/27
4,261,448 A * 4/1981 Myers et al. ..... 190/27
4,378,403 A * 3/1983 Kotcharian ..... 442/234
4,578,814 A * 3/1986 Skamser ..... 383/81
4,919,240 A * 4/1990 Tobias ..... 190/27
5,149,203 A * 9/1992 Sacks ..... 383/111
5,894,780 A * 4/1999 Taniguchi ..... 383/2
6,243,892 B1 * 6/2001 Kelling ..... 5/413 R
7,188,714 B1 * 3/2007 Herold ..... 190/127

* cited by examiner

*Primary Examiner* — J. Gregory Pickett
*Assistant Examiner* — Andrew Perreault
(74) *Attorney, Agent, or Firm* — Schwartz Law Firm, P.C.

(57) ABSTRACT

An expansible ballistic containment bag is adapted for safely storing weapons ammunition. The containment bag includes a blast-resistant flexible body defining an ammunition storage compartment, and having an access opening to the storage compartment for receiving weapons ammunition. A reinforcement webbing is attached to an outside of the flexible body, and incorporates an arrangement of spaced-apart longitudinal straps and spaced-apart lateral straps. At least one of the spaced-apart longitudinal straps extends substantially from one end of the flexible body to an opposite end of the flexible body, and is substantially continuously affixed along its length to the outside of the flexible body. At least two of the spaced-apart lateral straps substantial encircle the flexible body, and are substantially discontinuously affixed along their respective lengths to the containment bag.

19 Claims, 6 Drawing Sheets

EXPANSIBLE BALLISTIC CONTAINMENT BAG

TECHNICAL FIELD AND BACKGROUND

The present disclosure relates broadly to an expansible ballistic containment bag. In one exemplary implementation, the containment bag is applicable for safely storing and transporting weapons ammunition.

SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises an expansible ballistic containment bag adapted for safely storing weapons ammunition. The containment bag comprises a blast-resistant flexible body defining an ammunition storage compartment, and having an access opening to the storage compartment for receiving weapons ammunition. A reinforcement webbing is attached to an outside of the flexible body, and comprises an arrangement of spaced-apart longitudinal straps and spaced-apart lateral straps. At least one of the spaced-apart longitudinal straps extends substantially from one end of the flexible body to an opposite end of the flexible body, and is substantially continuously affixed along its length to the outside of the flexible body. At least two of the spaced-apart lateral straps substantial encircle the flexible body, and are substantially discontinuously affixed along their respective lengths to the containment bag.

The term "weapons ammunition" is defined broadly herein to mean any material adapted for being fired, scattered, dropped, or detonated from any weapon; and including for example, shot, shrapnel, bullets, or shells fired by guns.

The term "substantially continuously affixed" means attached, such as by sewing or other means, along at least 80% of the entire strap length adjacent the flexible body.

The term "substantially discontinuously affixed" means that at least 50% of the entire strap length adjacent the flexible body is unattached, such that the flexible body in an area of the unattached strap length is free to expand and distribute blast forces in the event of an explosion within the containment bag.

According to another exemplary embodiment, the reinforcement webbing comprises at least three uniformly-spaced lateral straps.

According to another exemplary embodiment, the reinforcement webbing comprises at least three uniformly-spaced longitudinal straps.

According to another exemplary embodiment, the reinforcement webbing further comprises at least one end strap extending around an end of the flexible body and integrally formed with at least one of the longitudinal straps.

According to another exemplary embodiment, the flexible body is shaped to receive a substantially rectangular weapons ammunition case.

According to another exemplary embodiment, the flexible body comprises a multiple layer fabric composite having an inside layer and an outside layer.

According to another exemplary embodiment, the inside layer of the fabric composite comprises chlorosulfonated polyethylene (CSPE) synthetic rubber.

According to another exemplary embodiment, the outside layer of the fabric composite comprises aramid fibers.

According to another exemplary embodiment, the reinforcement webbing comprises nylon.

According to another exemplary embodiment, the flexible body comprises first and second laterally-folding side closure flaps adapted for overlapping in a closed position at the access opening to the storage compartment.

According to another exemplary embodiment, first and second buckle straps extend across the first and second closure flaps in the closed position. The buckle straps have respective male and female buckle members adapted for releasably locking the first and second buckle straps together.

According to another exemplary embodiment, the flexible body further comprises a longitudinally-folding top closure flap adapted for substantially covering the first and second side closure flaps in the closed position.

According to another exemplary embodiment, at least one quick-release latch is adapted for substantially holding the top closure flap in place over the first and second side closure flaps in the closed position.

According to another exemplary embodiment, at least one of the longitudinal straps of the reinforcement webbing is substantially discontinuously attached along its length to the containment bag.

According to another exemplary embodiment, at least two of the lateral straps of the reinforcement webbing are attached to at least one of the longitudinal straps, and are substantially unattached to the flexible body. For example, in this embodiment, the lateral straps may be sewn directly to one or more of the spaced-apart longitudinal straps using (e.g.) a box stitch or 5-stitch bar tack, and may be entirely unattached to the flexible body in areas outside of the longitudinal straps.

BRIEF DESCRIPTION OF THE DRAWINGS

The description of exemplary embodiments proceeds in conjunction with the following drawings, in which.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
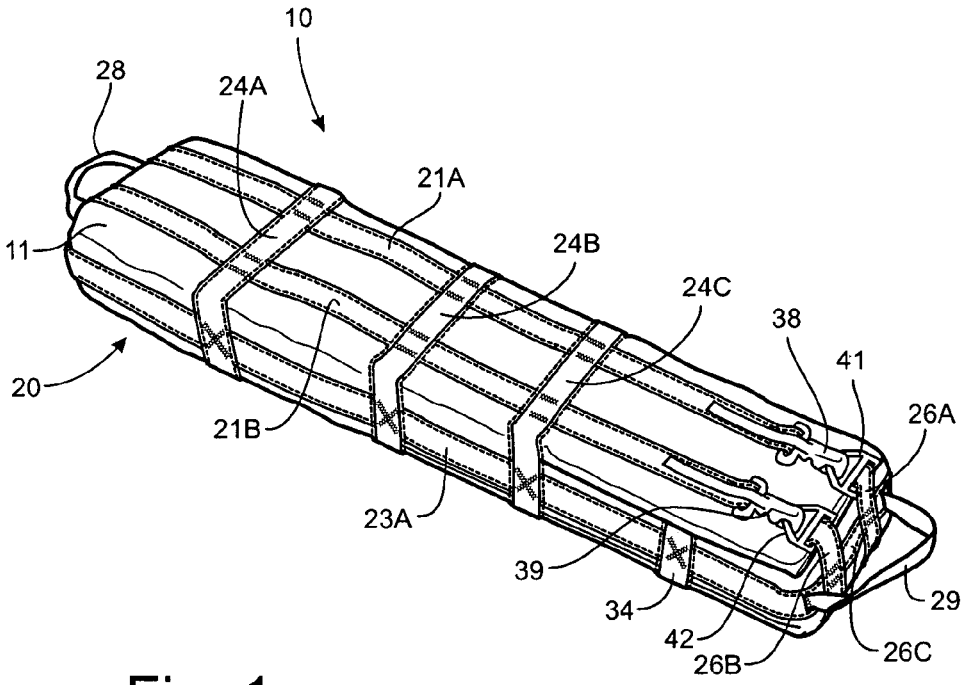
FIG. 1 is a top perspective view of an exemplary ballistic containment bag in a closed condition.
Figure 2:
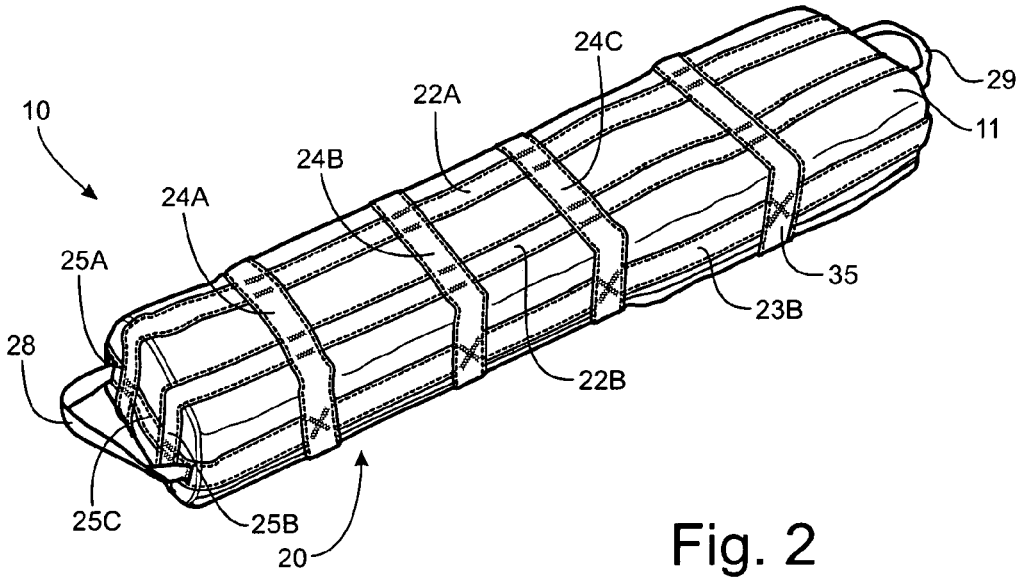
FIG. 2 is a bottom perspective view of the exemplary ballistic containment bag in the closed condition.
Figure 3:
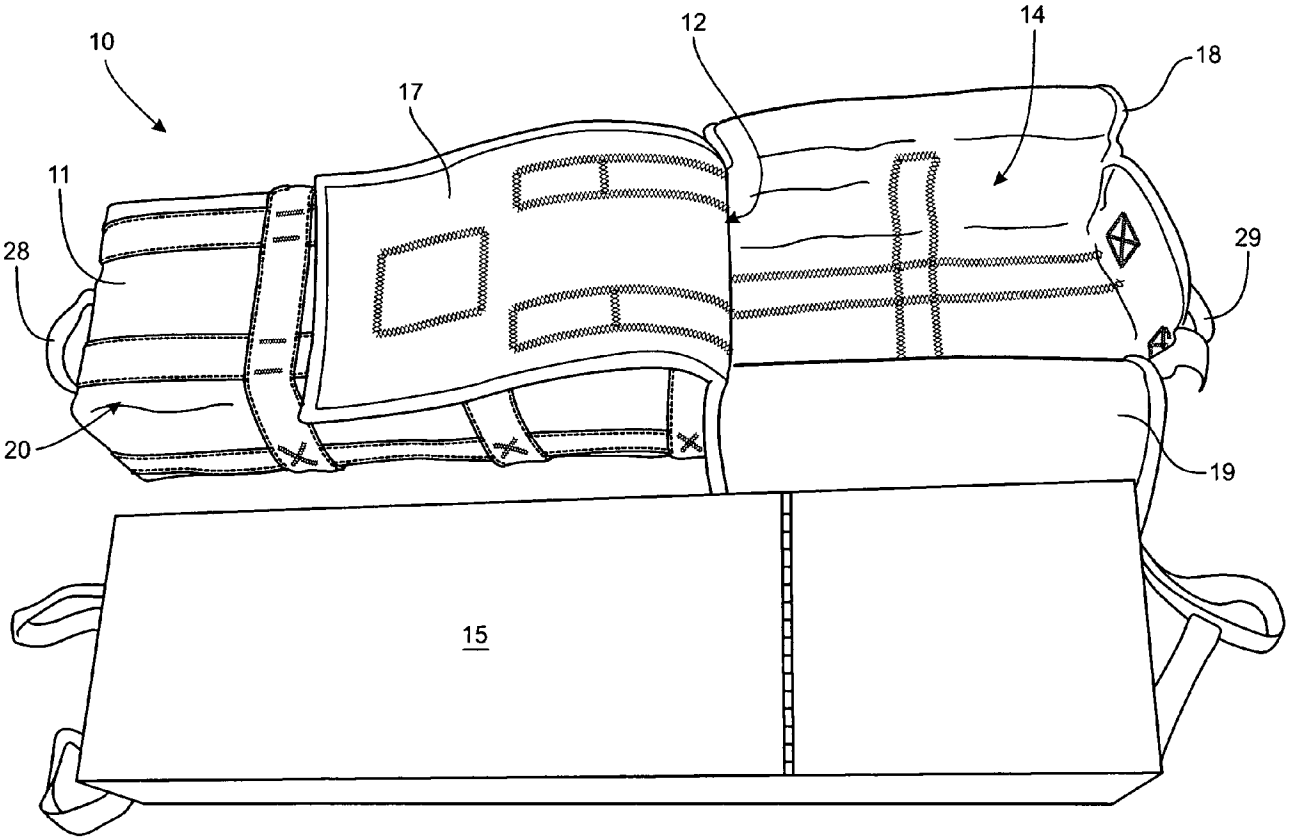
FIGS. 3, 4, 5, and 6 are sequential views demonstrating insertion and storage of an ammunition hotbox inside the exemplary ballistic containment bag.

Referring now specifically to the drawings, an expansible ballistic containment bag according to one exemplary embodiment of the present invention is illustrated in FIGS. 1 and 2, and shown generally at reference numeral 10. As best shown in FIG. 3, the containment bag 10 comprises a blast-resistant flexible body 11 defining an internal ammunition storage compartment 12, and having an access opening 14 to the storage compartment 12 designed to receive and safely store weapons ammunition 15. The weapons ammunition may comprise, for example, a 50-round, 25-MM ammunition case or "hotbox". In this embodiment, the open space defined by the storage compartment 12 is substantially rectangular to closely match the rectangular shape of the ammunition hotbox. After inserting the ammunition 15, the access opening 14 may be closed, as described below, using cooperating top and side closure flaps 17, 18, and 19.

Referring again to FIGS. 1 and 2, a nylon reinforcement webbing 20 is attached to an outside of the flexible body 11, and incorporates an interconnected strategically-spaced arrangement of longitudinal top, bottom and side straps 21A, 21B, 22A, 22B, and 23A, 23B; lateral straps 24A, 24B, and 24C; and end straps 25A, 25B, 25C and 26A, 26B, 26C. The exemplary strap width may range from 1"-2". In the present embodiment, the top and bottom longitudinal straps 21A, 21B, 22A, 22B extend substantially from one end of the bag 10 to the other, and are continuously affixed along their respective lengths to the flexible body 11 by, for example, sewing, adhesives, or other suitable means. The end straps 25A, 25B, 26A, 26B may be integrally-formed with respective top and bottom longitudinal straps 21A, 21B, 22A, 22B, and are likewise continuously sewn or otherwise affixed along their lengths to the flexible body 11. End straps 25C, 26C are integrally-formed with the side longitudinal straps 23A, 23B, and may also be continuously sewn along their lengths to the flexible body 11. To facilitate handling and transport of the containment bag 10, carry handles 28 and 29 may be attached to each of the end straps 25C, 26C.

The exemplary lateral straps 24A, 24B, 24C of the reinforcement webbing 20 are generally uniformly spaced along the length of the containment bag 10, and are directly permanently attached to the longitudinal top and side straps 21A, 21B, 23A, 23B using (e.g.) a box stitch or 5-stitch bar tack. The lateral straps 24A, 24B, 24C are generally unattached to the flexible body 11 in all areas other than the longitudinal straps 21A, 21B, 23A, 23B. In other words, the lateral straps 24A, 24B, 24C are unattached to the bottom longitudinal straps 22A, 22B, and to areas of the fabric bag between adjacent top and side straps 21A, 21B, 23A, 23B. The side longitudinal straps 23A, 23B are integrally-formed with end straps 25C, 26C, as indicated above, and may be generally unattached to the flexible body 11 therebetween. In the present example, the discontinuous attachment of the lateral straps 24A, 24B, 24C and opposing side longitudinal straps 23A, 23B enables significant expansion (or inflation) of the flexible body 11, and promotes relatively uniform distribution of blast forces across the reinforcement webbing 20 in the event of an ammunition explosion inside the containment bag 10.

Figure 4:
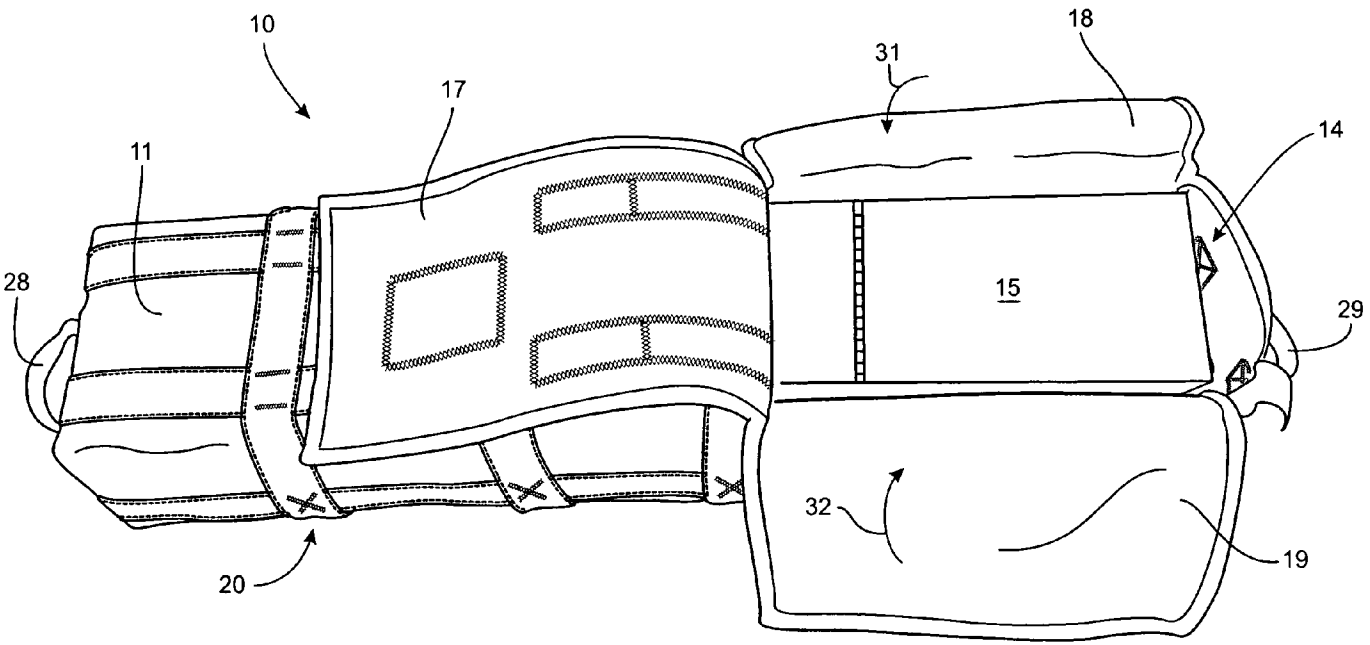
Figure 5:
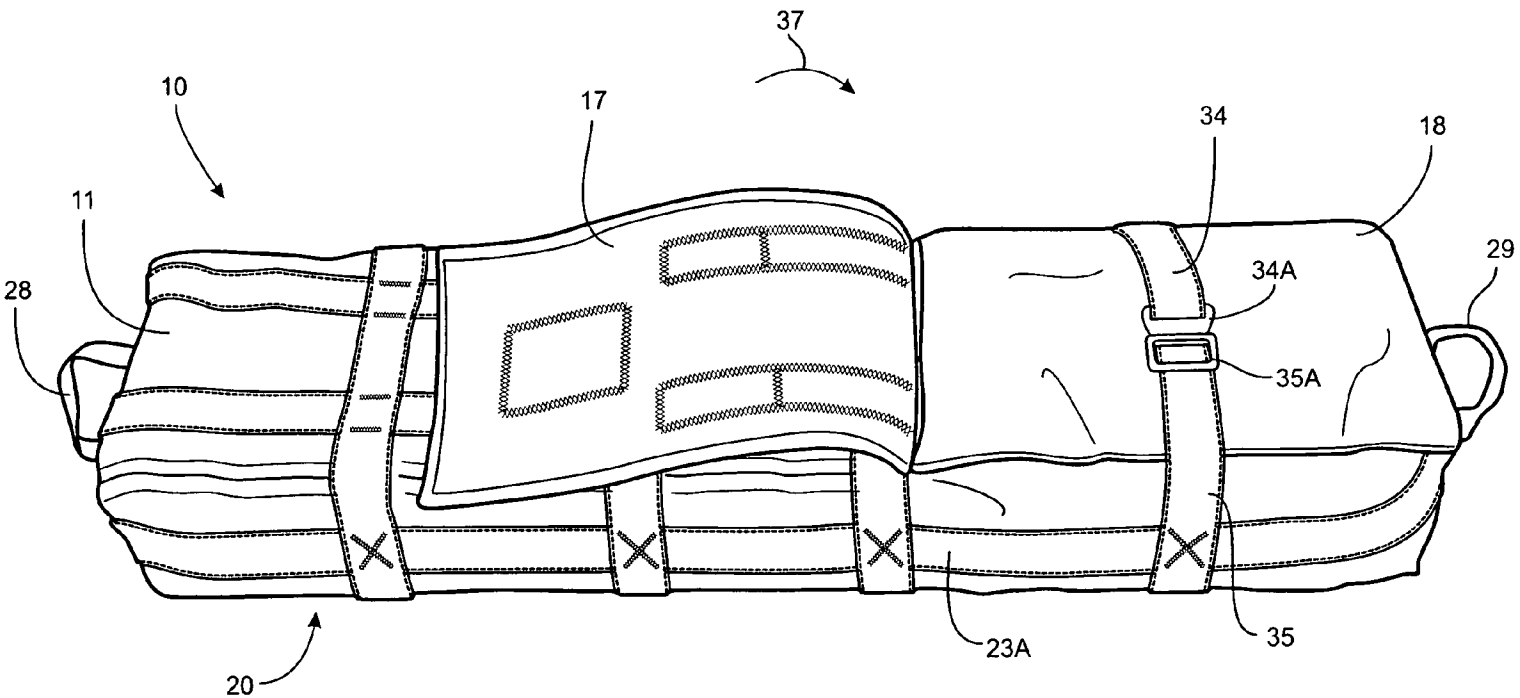
Figure 6:
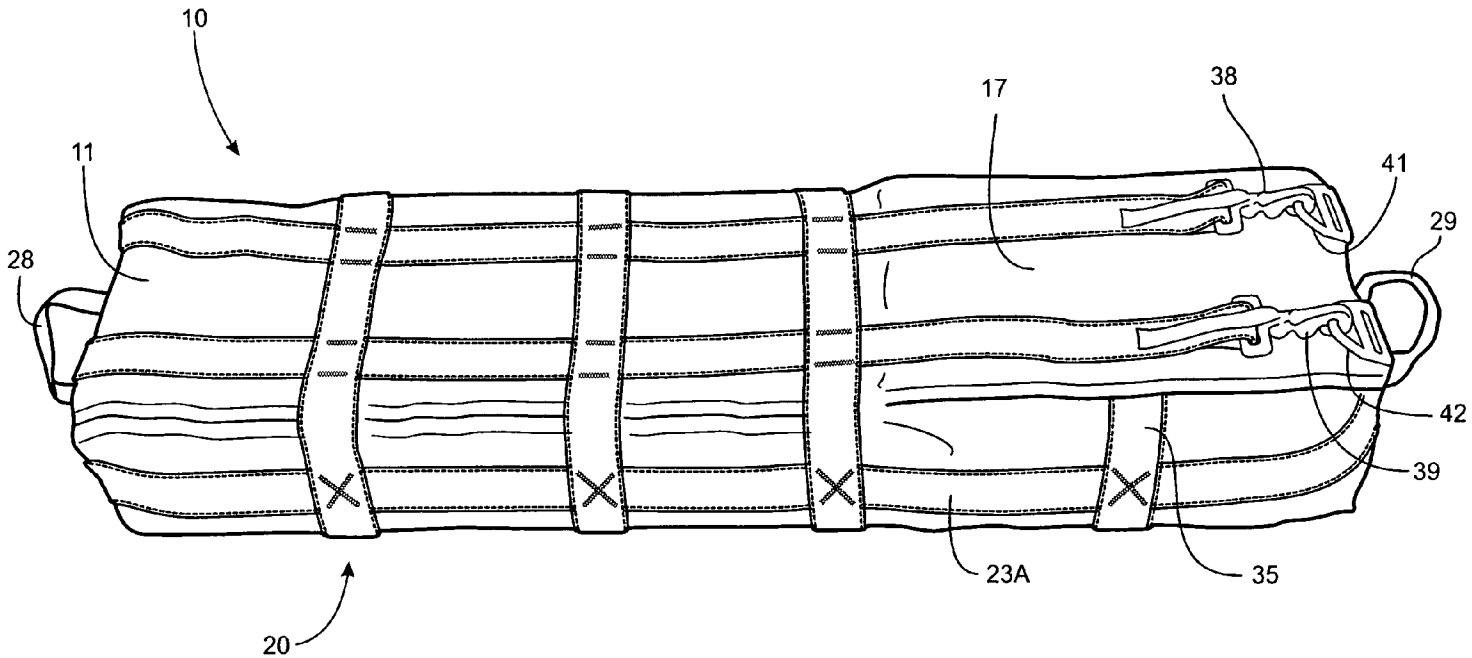

FIGS. 3, 4, 5 and 6 demonstrate sequential steps for closing the access opening 14 to the ammunition storage compartment 12 of the containment bag 10. After the ammunition hotbox 15 is inserted into the storage compartment 12, as shown in FIGS. 3 and 4, the side closure flaps 18, 19 are folded laterally as indicated by arrows 31 and 32 to substantially overlap across the access opening 14. Referring to FIG. 5, cooperating bag-encircling buckle straps 34 and 35 are attached to respective side longitudinal straps 23A, 23B (23B shown in FIG. 2), and have respective male and female buckle elements 34A, 35A which mate to releasably lock the straps 34, 35 together across the closure flaps 18, 19. After attaching the buckle straps 34, 35, the top closure flap 17 is folded longitudinally as indicated by arrow 37 to substantially cover the side closure flaps 18, 19 in their closed position. Finally, as shown in FIG. 6, quick-release latches 38 and 39 (or snap hooks) are attached to respective anchor V-rings 41 and 42 affixed to the flexible body 11 at one end of the bag 10 to secure the top closure flap 17 in position over the overlapping side closure flaps 18, 19. Once closed, any open seams defined by the closure flaps 17, 18, 19 may be closed using (e.g.) nylon tape or other means.

Figure 7:
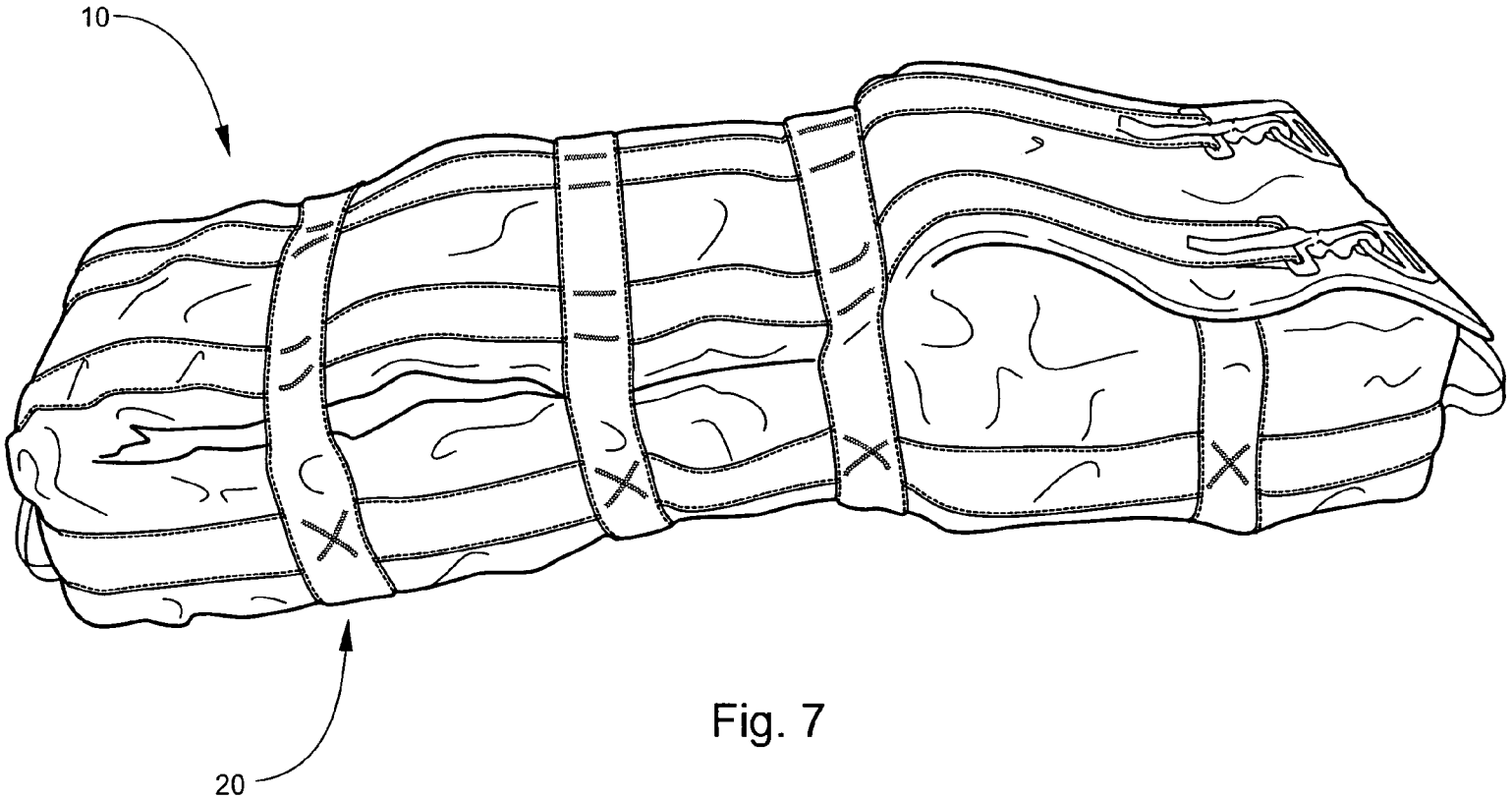
FIG. 7 illustrates an expansion or inflation of the ballistic containment bag during an ammunition explosion inside the bag.

In one exemplary embodiment, the flexible body 11 including each of the closure flaps 17, 18, 19 is constructed of a multiple layer ballistic fabric composite comprising an inner layer of aramid, such as KEVLAR®, and a flame-resistant outer layer of chlorosulfonated polyethylene (CSPE) synthetic rubber, such as HYPALON®—both materials manufactured by E. I. du Pont de Nemours and Company. The inner and outer layers may be laminated using an adhesive resin, thermoplastic film or the like. While the ballistic flexible body 11 and closure flaps 17, 18, 19 effectively contain shrapnel caused by hotbox destruction during a mine blast (or the like), the reinforcement webbing 20 secures the structure of the containment bag 10 by distributing blast forces and allowing expansion (or inflation) particularly in areas of its discontinuous attachment to the flexible body 11. FIG. 7 illustrates expansion of the containment bag 10 at the time of explosion. In one embodiment, the total volume of the internal storage compartment 12 (FIG. 3) expands more than approximately 10% during an ammunition explosion; and alternatively, expands more than approximately 20% during an ammunition explosion.

For the purposes of describing and defining the present invention it is noted that the use of relative terms, such as "substantially", "generally", "approximately", and the like, unless otherwise defined herein, are utilized to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

I claim:

1. An expansible ballistic containment bag adapted for safely storing weapons ammunition, said containment bag comprising:

a blast-resistant flexible body defining an ammunition storage compartment, and comprising an access opening to said storage compartment for receiving weapons ammunition;

a reinforcement webbing attached to an outside of said flexible body, and comprising an arrangement of spaced-apart longitudinal straps and spaced-apart lateral straps;

at least one of said spaced-apart longitudinal straps extending substantially from one end of said flexible body to an opposite end of said flexible body, and being substantially continuously affixed along its length to the outside of said flexible body, and another of said spaced-apart longitudinal straps being substantially discontinuously attached along its length to said containment bag; and at least two of said spaced-apart lateral straps substantially encircling said flexible body, and being substantially discontinuously affixed along their respective lengths to said containment bag, wherein at least one of said lateral straps is attached to at least two of said spaced-apart longitudinal straps, and is substantially unattached to said flexible body between said at least two longitudinal straps, whereby the discontinuous attachment of said at least one lateral strap enables expansion of said flexible body, and promotes distribution of blast forces across said reinforcement webbing in the event of an ammunition explosion inside said containment bag.

2. An expansible ballistic containment bag according to claim 1, wherein said reinforcement webbing comprises at least three uniformly-spaced lateral straps.

3. An expansible ballistic containment bag according to claim 1, wherein said reinforcement webbing comprises at least three uniformly-spaced longitudinal straps.

4. An expansible ballistic containment bag according to claim 1, wherein said reinforcement webbing further comprises at least one end strap extending around an end of said flexible body and integrally formed with at least one of the longitudinal straps.

5. An expansible ballistic containment bag according to claim 1, wherein said flexible body is substantially rectangular.

6. An expansible ballistic containment bag according to claim 1, wherein said flexible body comprises a multiple layer fabric composite having an inside layer and an outside layer.

7. An expansible ballistic containment bag according to claim 6, wherein the inside layer of said fabric composite comprises chlorosulfonated polyethylene (CSPE) synthetic rubber.

8. An expansible ballistic containment bag according to claim 7, wherein the outside layer of said fabric composite comprises aramid fibers.

9. An expansible ballistic containment bag according to claim 1, wherein said reinforcement webbing comprises nylon.

10. An expansible ballistic containment bag according to claim 1, wherein said flexible body comprises first and second laterally-folding side closure flaps adapted for overlapping in a closed position at said access opening.

11. An expansible ballistic containment bag according to claim 10, and comprising first and second buckle straps extending across said first and second closure flaps in the closed position, said buckle straps having respective male and female buckle members adapted for releasably locking said first and second buckle straps together.

12. An expansible ballistic containment bag according to claim 10, wherein said flexible body further comprises a longitudinally-folding top closure flap adapted for substantially covering said first and second side closure flaps in the closed position.

13. An expansible ballistic containment bag according to claim 12, and comprising at least one quick-release latch adapted for substantially holding said top closure flap in place over said first and second side closure flaps in the closed position.

14. An expansible ballistic containment bag according to claim 1, wherein at least two of the lateral straps of said reinforcement webbing are attached to at least one of the longitudinal straps, and are substantially unattached to said flexible body.

15. In combination with weapons ammunition, an expansible ballistic containment bag safely storing the ammunition and comprising:

a blast-resistant flexible body defining an ammunition storage compartment, and comprising an access opening to said storage compartment for receiving weapons ammunition;

a reinforcement webbing attached to an outside of said flexible body, and comprising an arrangement of spaced-apart longitudinal straps and spaced-apart lateral straps;

at least one of said spaced-apart longitudinal straps extending substantially from one end of said flexible body to an opposite end of said flexible body, and being substantially continuously affixed along its length to the outside of said flexible body, and another of said spaced-apart longitudinal straps being substantially discontinuously attached along its length to said containment bag; and at least two of said spaced-apart lateral straps substantially encircling said flexible body, and being substantially discontinuously affixed along their respective lengths to said containment bag, wherein at least one of said lateral straps is attached to at least two of said spaced-apart longitudinal straps, and is substantially unattached to said flexible body between said at least two longitudinal straps, whereby the discontinuous attachment of said at least one lateral strap enables expansion of said flexible body, and promotes distribution of blast forces across said reinforcement webbing in the event of an ammunition explosion inside said containment bag.

16. A combination according to claim 15, wherein said reinforcement webbing further comprises at least one end strap extending around an end of said flexible body and integrally formed with at least one of the longitudinal straps.

17. A combination according to claim 15, wherein said flexible body comprises first and second laterally-folding side closure flaps adapted for overlapping in a closed position at said access opening.

18. A combination according to claim 17, wherein said flexible body further comprises a longitudinally-folding top closure flap adapted for substantially covering said first and second side closure flaps in the closed position.

19. A combination according to claim 15, wherein at least two of the lateral straps of said reinforcement webbing are attached to at least one of the longitudinal straps, and are substantially unattached to said flexible body.

* * * * *